US006099624A

United States Patent [19]

Martyak

[11] Patent Number: 6,099,624

[45] **Date of Patent: *Aug. 8, 2000**

[54] NICKEL-PHOSPHORUS ALLOY COATINGS

[75] Inventor: Nicholas M. Martyak, Doylestown, Pa.

[73] Assignee: Elf Atochem North America, Inc., Philadelphia, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/078,419

[22] Filed: May 14, 1998

Related U.S. Application Data

[60] Provisional application No. 60/052,039, Jul. 9, 1997.

[51] Int. Cl.[7] ..... C25D 3/58

[52] U.S. Cl. ..... 106/1.27; 205/258

[58] Field of Search ..... 205/258, 255, 205/260; 106/1.27

[56] References Cited

U.S. PATENT DOCUMENTS

| | | | |
|---|---|---|---|
| 4,411,961 | 10/1983 | Tremmel | 428/613 |
| 4,470,886 | 9/1984 | Duva et al. | 204/43 |
| 4,483,711 | 11/1984 | Harbalak et al. | 106/1.22 |
| 4,699,695 | 10/1987 | Rieger | 204/33 |
| 5,336,567 | 8/1994 | Watanabe et al. | 428/629 |
| 5,863,407 | 1/1999 | Kiyokawa | 205/159 |
| 5,944,879 | 2/1999 | Martyak | 106/1.22 |

*Primary Examiner*—Kishor Mayekar
*Attorney, Agent, or Firm*—Gilbert W. Rudman; Stanley A. Marcus

[57] ABSTRACT

Nickel phosphorus alloys can be electroplated from an aqueous acidic solution containing nickel alkane sulfonate and phosphorus acid.

5 Claims, No Drawings

NICKEL-PHOSPHORUS ALLOY COATINGS

This application claims the benefit of United States Provisional Application No. 60/052,039, filed on Jul. 9, 1997.

BACKGROUND OF THE INVENTION

1. Field of Invention

The field of the invention relates to a bath for electroplating nickel-phosphorus alloys coatings to conductive substrates and processes utilizing such baths.

2. Description of the Prior Art

Nickel phosphorus (NiP) alloys are coatings which exhibit good corrosion protection and excellent wear properties. The automotive industry applications include use on decorative parts such as exposed trim where both corrosion protection and estestics are important. Engineering applications include those where wear protection, corrosion protection and/or estestics are important, for example, coating of internal tanks and vessels such as fuel tanks, piston rings and shock absorbers. Many tools are coated with a NiP alloy to increase their service life because of the hardness of the NiP coating compared to pure nickel coatings. Additional uses are found in catalysis and electrical applications. There are several methods to produce NiP alloy coatings. One is rapid quenching from a melt containing nickel and phosphorus. Another is vapor deposition which produces NiP alloys containing variable amount of occluded phosphorus.

Perhaps the most widely used method to produce NiP alloys is through electroless deposition which uses a hypophosphite anion as a reducing agent in the plating solution. During the deposition of nickel on a conductive substrate, the hypophosphite may be reduced to elemental phosphorus and is occluded in the nickel coating. However, the plating rates from an electroless nickel solution are very slow compared to electrolytic deposition. Therefore, several studies have investigated the use of DC plating to deposit NiP alloys at higher deposition rates. It has been found that nickel deposits with up to 18% phosphorus in the coatings are possible through variations in the phosphorus containing species and current densities.

The electrolytic solutions in the literature employ nickel sulfate as the source of nickel. A typical nickel sulfate solution contains nickel sulfate (about 150–250 g/l), nickel chloride (about 45–50 g/l), phosphorus acid (about 10–50 g/l), phosphoric acid (about 0–40 g/l) and boric acid (about 0–10 g/l). The operating pH is between about 0.8–10 and the temperature may vary from 50–75° C. In order to facilitate and maintain a high consistent deposit a high temperature and usually high agitation of the electrolyte is necessary.

It would be desirable to have baths other than nickel sulfate from which to electrodeposit nickel for several reasons.

One is that the amount of the phosphorus acid or phosphoric acid used in the prior art electrolytic baths is critical. If there is too high a concentration, the deposition of nickel is inhibited. If the concentration of either phosphorus acid or phosphoric acid gets out of balance, the only means to bring them back in the normal range is to dilute the bath. It would be advantageous if the concentration of phosphorus acid and phosphoric acid could be adjusted without diluting the bath.

Another is that since energy costs are an important consideration in the electroplating industry it would be advantageous to use an electrolyte which had higher conductivity than the baths of the prior art, thereby requiring less voltage for the same current density. Higher conductivity of the bath is especially important in high speed plating using a narrow anode-cathode spacing.

Accordingly, the present invention seeks to obtain the advantages of avoiding these and other difficulties encountered in the related art. These and other advantages are obtained according to the present invention which is the provision of a process and composition of matter that substantially obviates one or more of the limitations and disadvantages of the described prior processes and compositions of matter of the related art.

SUMMARY OF THE INVENTION

To achieve these and other advantages, and in accordance with the purpose of the invention, as embodied and broadly described, the invention comprises a composition of matter which allows the use of nickel alkane sulfonate in an electrodepositing process to produce nickel phosphorus alloy coatings.

One embodiment of the invention is a composition of matter for producing electrodeposited nickel phosphorus alloy coatings. The composition is an acidic aqueous electroplating bath comprising a nickel alkane sulfonate, phosphorous acid and, optionally, phosphoric acid and/or hypophosphorous acid.

Another embodiment of the present invention is a process for producing electrodeposited coatings by electroplating a cathodic conductive substrate in a coating bath having an anode inserted therein, the bath consisting of a nickel alkane sulfonate and phosphorous acid; maintaining the coating bath at a pH from about 0.1 to about 10; and maintaining the current density on the substrate at from about 0.1 to about 200 $A/dm^2$.

Another embodiment of the invention is an improvement in a process for producing electrodeposited nickel or nickel alloy coatings. The process comprises electroplating a cathodic conductive substrate in a coating bath having an anode therein and the coating composition containing nickel ion. The improvement is the concurrent use of both an insoluble and a soluble anode.

Another embodiment of the invention is a composition of matter for replenishing a spent electroplating bath containing $Ni(CH_3SO_3)_2$ and phosphorous acid; the bath having been used for producing electrodeposited a nickel/phosphorus coating. The replenishing composition is a solution comprising nickel phosphite.

Another embodiment of the invention is a process for replenishing a spend acidic aqueous electroplating bath comprised of a nickel alkane sulfonate, phosphorous acid and, optionally, phosphoric acid and/or hypophosphorous acid. The process is to add to the spend bath (a) a slurry comprising nickel carbonate and (b) a solution containing a phosphorous containing acid.

The process and composition of the invention provide excellent nickel phosphorous coatings on conductive substrates.

DETAILED DESCRIPTION OF THE INVENTION

The description which follows sets forth additional features and advantages of the invention which, in part, will become apparent from the description or learned by practice of the invention. The skilled artisan will realize the objectives and other advantages of the invention obtained by the processes and composition of matters particularly pointed out in the written description and claims hereof.

The electroplating baths of the present invention generally comprise a mixture of:

a—from about 50 to 600 gram/liter, preferably 150 to 300 gram/liter, of nickel alkane sulfonic acid;

b—from about 2 to 80 gram/liter, preferably 5 to 40 gram/liter, of phosphorous acid ($H_3PO_3$);

c—optionally, from 0 to about 70 grams/liter, preferably 10 to 50 grams/liter, of phosphoric acid ($H_3PO_4$); and d—optionally, from 0 to about 50 grams/liter, preferably 5 to 25 grams/liter, of hypophosphoric acid ($H_3PO_2$)

Nickel/Phosphorus Coating

The nickel phosphorous alloys produced by the process of this invention contain from about 0.5% to 25%, preferably 3% to 15%, by weight phosphorus. The percentage of the alloy coating which is phosphorous is dependent on several factors, such as, concentration of phosphorous ion in the bath, the current density used in the process and the temperature. Artisans know how to vary each of these factors to obtain a desired alloy coating. Alloys containing less than about 4% phosphorous are crystalline and have increased hardness. Alloys having more than about 9% phosphorous tend to be amorphous and have greater corrosion resistance and thus find use, for example, where non-magnetic coatings are desired. Alloys having between about 4 to 9% phosphorous are semi-amorphous and find use in applications where a barrier layer is needed on a substrate.

Nickel Alkane Sulfonate

The nickel alkane sulfonate is derived from sulfonic acids of the formula (R) $(SO_3)_x$, where R and x are defined hereinafter.

The nickel alkane sulfonate is a water soluble compound by which it is meant that the compound is soluble in water at about room temperature (about 20° C.) or lower (about 10° C. to about 20° C.), and preferably from these temperatures up to or slightly below the operating temperature of the bath, and has the formula:

$$Ni[(R)(SO_3)_x]_y \qquad \text{formula (A)}$$

where x has a value from 1 to about 3; and y has a value from 1 to 2 so that y may be 1 when x is greater than 1.

R is an alkyl group having from 1 to about 15 carbon atoms and especially 1 to about 7 carbon atoms including the straight chain and branch chain isomers thereof such as methyl, ethyl, propyl, isopropyl, butyl, t-butyl, isobutyl, pentyl, isopentyl, and the like. Hydroxy substituted alkyls, as alkyl is defined herein, are also included. Specific nickel salts in this regard comprise nickel methane sulfonate, nickel ethane sulfonate, nickel propane sulfonate, nickel isopropane sulfonate, nickel butane sulfonate, nickel isobutane sulfonate, nickel t-butane sulfonate, nickel pentane sulfonate, nickel isopentane sulfonate, and the like, as well as the hydroxy substituted compounds thereof. R also includes cyclic, and heterocyclic hydrocarbon substituents such as cycloaliphatic, unsaturated cycloaliphatic, and aromatic groups having from 4 to about 16 carbon atoms and especially from about 6 to about 14 carbon atoms including cyclobutyl, cyclobutenyl, cyclohexyl, cyclohexenyl, cyclohexadienyl, cyclooctanyl, and cyclooctadienyl.

The compound is present the bulk in sufficient quantity so that the concentration of $Ni^{++}$ is about 10 to 130 g/l, more preferably about 30 to 90 g/l, most preferably about 70 g/l.

Preferred for use in the bath of the present invention is nickel methane sulfonate—$Ni(CH_3SO_3)_2$.

The nickel alkane sulfonate in the bath can be produced either ex-situ or in-situ. That is, the preformed nickel alkane sulfonate may be mixed directly into the aqueous medium to form a plating solution, or, if desired, a basic nickel salt (e.g., nickel carbonate) may be added to an aqueous medium containing a measured amount of an alkane sulfonic acid to form the soluble compound in situ.

Other Alloys of Nickel/Phosphorus

The invention also includes depositing other alloys of nickel/phosphorus as the coating of the present invention, and can employ alkane sulfonate salts of the alloying metals and nickel alkanesulfonates, where in formula (A), the alloying metal will be substituted for "Ni", "y" has a value of 1 up to the valence of the alloying metal, and "x" has the values given above.

Alloys of nickel may also be deposited employing alloying additives to the coating bath in lieu of or in addition to the sulfonate alloying compounds described herein. Any of the other Group IB, IIB, IIIA, IVA, IVB, VA, VB, VIB, VIIB or VIIIB metals may be used as alloying metals. Mixtures of alloying metals from Group VIII and/or Group IIB or Cr or Mn may also be prepared, especially the two component or three component alloys where the alloying metal is present in the coating in an amount anywhere from about 0.1 to about 20 percent by weight and especially from about 5 to about 15 percent by weight. Examples resulting alloys include NiPZn, NiPCr, NiPFe, NiPMn, NiPSn and NiPW.

The alloys are prepared by inserting the alloy metal into the coating baths either as an anode in a manner well known in the art or by adding a salt of the alloying metal to the coating bath.

Phosphorous Acid ($H_3PO_3$), Phosphoric Acid ($H_3PO_4$), and Hypophosphorous Acid ($H_3PO_2$)

These phosphorous containing acids are the source of the phosphorous which is electrodeposited in the coating, with phosphorous acid being the principle source.

It is preferable to use reagent grades of these acids to ensure that the addition of solutions of these acids do not impart undesired levels of calcium and/or other impurities in the bath which would impact negatively on the process or the resulting alloy coating. However, any grade of these solutions may be used, if the use of such grade results in a process and/or coating which satisfies the operator of the process or user of the alloy.

Other Additives to the Bath

It is also within the scope of the invention to adjust the bath by the addition of other components known to these skilled in the art.

Such other additives include, for example, a—buffers, such as boric acid, 0 to about 60 g/l, preferably 35 to 45 g/l;

b—surfactant, for example, sodium lauryl sulfate, 0 to about 2 ml/l, preferably about 1 ml/l, to reduce surface tension and prevent bubbling of hydrogen gas;

c—stress-reducing additive, 0.5 to 15 g/l, preferably 2 to 15 g/l, more preferably 5 to 10 g/l, and most preferably about 8 g/l, to impart compressive stress to the deposited coating (usually the concentration of the additive will range from 5 to 20% of the concentration of the nickel ion present in the bath);

d—nickel chelating or sequestering agents.

Examples of stress-reducing additives include aromatic sulfonic acids, such as aminobenzene sulfonic acid, benzene sulfonic acid, benzene disulfonic acid, napththylamine disulfonic acid, naphthalene monosulfonic acid, naphthalene disulfonic acid, naphthalene trisulfonic acid, naphthol monosulfonic acid and p-toluene sulfonic acid and other compounds including benzene sulfamide, cysteine hydrochloride, saccharin, p-toluene sulfonamide, thioacetamide, thiosemicarbazide and thiourea.

Nickeling chelating or sequestering agents assist in maintaining the nickel ion in solution at pHs greater than 5.0. Useful agents include carboxylic acids such as lactic, citric, malic, tartaric, phosphonic acids, amines, ammonia, ammonium salts or combinations thereof.

When soluble nickel anodes are used in the process, the bath preferably also contains a nickel halogen, such as, for example, $NiCl_2$ or $NiBr_2$. The nickel halogen aids in the dissolution of the soluble anode. The amount of nickel halogen present in the bath is about 0 to 100 g/l, preferably 20 to 40 g/l.

pH

Electrodeposition according to the process takes place at a pH from about 0.1 to about 10. For acidic solutions the pH is preferably from about 0.5 to about 3.0, and most preferably about pH 1 to 2. For neutral solutions employing a nickel chelating agent, the pH is from about 6 to about 8. For alkaline solutions the pH is from about 8 to about 12, most preferably from about 8 to about 10.

Current Density

The composition and process of the present invention operates at current densities from about 0.1 Amps/$dm^2$ to about 200 Amps/$dm^2$ and preferably from about 2 Amps/$dm^2$ to about 100 Amps/$dm^2$. In high speed plating such as on steel strip, shock rods, struts, or printer rollers, the preferred current density is about 5 Amps/$dm^2$ to about 100 Amps/$dm^2$.

Temperature

The process of the invention proceeds at temperatures from about room temperature (20° C.), to about 90° C., and preferably from about 30° C. to about 80° C., and most preferably from about 50° C. to about 70° C.

Agitation

In order to prevent "burning" of high current density areas and provide for more even temperature control of the solution, solution agitation may be employed. Air agitation, mechanical stirring, pumping, cathode rod and other means of solution agitation are all satisfactory. Additionally, the solutions may be operated without agitation.

In high speed plating such as on steel strip, the agitation of the bath preferably produces a flow rate of about 0.5 to 5 meters/sec.

Replenishing Composition

When the process utilizes an insoluble anode, eventually the bath solution will need to be replenished to have sufficient nickel and phosphorous present in the bath to enable the electrodeposition of the nickel/phosphorous alloy. Of course, any bath component that is also consumed during the process (e.g., phosphate species) can also be incorporated in any replenishment solution.

One suitable method for replenishing the spent nickel alkane sulfonate/phosphorous ion containing electroplating bath is to place into the bath a slurry comprising nickel carbonate and a solution containing a phosphorous containing acid. A dissolved nickel phosphorous compound is formed in situ and results in replenishment of the nickel and phosphorous in the bath and an increase in the pH of the bath. The phosphorous containing acid is one or more of phosphorous acid ($H_3PO_3$), phosphoric acid ($H_3PO_4$), and hypophosphorous acid ($H_3PO_2$).

Another suitable method for replenishing the spent nickel alkane sulfonate/phosphorous ion containing electroplating bath is to place into the bath a solution of nickel phosphite which replenishes the nickel and phosphorous in the bath.

The amount of each component used in the replenishing solution or in the slurry and/or solutions individually added to the spent bath will depend on the conditions under which the electroplating process is conducted and the desired characteristics of the alloy. For example, if a NiP alloy with 5% P is desired, a replenishment solution will be formulated to have the correct proportions of both $Ni^{+2}$ and $H_3PO_3$ of course, if a NiP alloy with 12% P in the coating is desired then the replenishment solution would be formulated to contain more $H_3PO_3$.

It is also within the scope of the present invention to use a soluble calcium salt, such as, $CaCO_3$, CaO or $Ca(MSA)_2$, to control phosphorus and phosphoric species in the bath. If the $PO_3$ and/or $PO_4$ species get out of specification, the soluble calcium salt can be added to the bath to precipitate the $PO_3$ and/or $PO_4$ species thus eliminating the need to purge the bath. Of course, other compounds that form a soluble salt with MSA but form an insoluble phosphite salt, for example, $Li^+$, $Ba^{+2}$, $Sr^{+2}$, alkaline earth metal, can be used instead of a calcium salt. The use of these salts can not be used in the prior art $NiSO_4$ baths because the $Ca^{+2}$ would preferentially precipitate the $SO_4^{-2}$.

Anodes

The anodes useful in the process of the present invention include soluble anodes, such as, for example, nickel foil, and insoluble anodes, such as, for example, platinum and precious metal oxides.

It is preferred to use both soluble and insoluble anodes in the electrolytic process in order to control the $Ni^{+2}$ concentration. Since the cathode efficiency is between 50–75%, depending upon bath composition and current density, and the anode dissolution efficiency is about 100%, the $Ni^{+2}$ concentration slowly increases and eventually it becomes necessary to purge the bath to bring the $Ni^{30\ 2}$ back into the normal operating range. However, by diluting the entire solution, the other bath components must also be brought back into specification. The use of a combination of soluble and insoluble anodes maintains the $Ni^{+2}$ concentration and alleviates the need to purge the solution.

Substrate (cathode)

Electroplating proceeds in the manner described herein by electrolytically coating a conductive substrate from the composition of the invention, where the substrate (cathode) comprises any electrically conductive substrate or polymer substrate, or insulating substrate (e.g., a polymeric material, such as a synthetic polymeric substrate, or a ceramic substrate) coated with a conductive material such as a metal or any art known conductive substrates such as a carbon substrate.

Although the examples describe the electroplating process as one that is conducted on a steel substrate, any conductive substrate may be employed whether a polymer, plastic, pure metal, a metal alloy, and includes other iron-alloy substrates or metals or alloys based on Groups IB, IIB, IIIA, IVA, IVB, VA, VB, VIB, VIIB or VIIIB metals and elements, the alloys comprising combinations of two or more of these metals and elements, especially the two or three or four component combinations of metals and elements.

The substrates that industry will principally use with the composition and process of the present invention are iron, iron alloys (including steel), aluminum, aluminum alloys, copper and copper alloys.

Process

Coating proceeds by passing a current between the anode in the electrocoating bath to the cathode substrate in the bath for a period of time sufficient to deposit the desired coating on the cathode.

Conductivity

The conductivity of a nickel alkane sulfonate solution is higher than that of a nickel sulfate solution at a given nickel ion concentration if the nickel salt is the only variable in the plating solution. This inherently higher conductivity will result in a process requiring less plating voltage at a given current density. The lower voltage therefore decreases the number of kilowatt hours necessary to plate a substrate with a nickel-phosphorus coating thereby decreasing the operating cost to the plater.

The various numerical ranges describing the invention as set forth throughout the specification also include any combination of the lower end of the range with the higher end of the range set forth herein including, inter alia, ranges of concentrations of compounds, ratios of these compounds to one another, molecular weights, pH, current densities, temperatures, and the like, as well as all whole number and/or fractional number values and ranges encompassed within these ranges.

EXAMPLE 1

An aqueous bath was prepared by adding to water, 10 g/l of phosphorous acid and sufficient stoichiometric amounts of nickel carbonate and methane sulfonic acid to form in situ Ni(methane sulfonate)$_2$ and result in a concentration of 70 g/l of $Ni^{+2}$.

The bath was employed to deposit a nickel-phosphorus coating on a steel plate using a conventional laboratory scale electroplating method with air agitation at 55° C. The anode was insoluble iridium oxide. The average current density was about 10 amp per dm$^2$. The pH of the bath at the start of plating was 1.2.

The deposition is carried out for 15 minutes to provide a coating 6 to 9 $\mu$m thick. The coating was semi-bright and adherent. The cathode efficiency was 75%. The stress in the coating was −2150 PSI (compressive).

EXAMPLE 2

An aqueous bath was prepared by adding to water, 10 g/l of phosphorous acid and sufficient stoichiometric amounts of nickel carbonate and methane sulfonic acid to form in situ Ni(methane sulfonate)$_2$ and result in a concentration of 70 g/l of $Ni^{+2}$.

The bath was employed to deposit a nickel-phosphorus coating on a steel plate using a conventional laboratory scale electroplating method with air agitation at 55° C. The anode was insoluble iridium oxide. The average current density was about 4 amp per dm$^2$. The pH of the bath at the start of plating was 1.6 and at the end of plating 1.4.

The deposition is carried out for 15 minutes to provide a coating 5 to 7 $\mu$m thick. The coating was semi-bright and adherent. The cathode efficiency was 55%.

EXAMPLE 3

An aqueous bath was prepared by adding to water, 10 g/l of phosphorous acid and sufficient stoichiometric amounts of nickel carbonate and methane sulfonic acid to form in situ Ni(methane sulfonate)$_2$ and result in a concentration of 70 g/l of $Ni^{+2}$.

The bath was employed to deposit a nickel-phosphorus coating on a steel plate using a conventional laboratory scale electroplating method with mechanical agitation at 55° C. The anode was insoluble iridium oxide. The average current density was about 20 amp per dm$^2$. The pH of the bath at the start of plating was 1.5 and at the end of plating 1.3. The deposition is carried out for 15 minutes to provide a coating 7 to 10 $\mu$m thick. The coating was adherent and semi-bright. The cathode efficiency was 77%.

EXAMPLE 4

An aqueous bath was prepared by adding to water, 10 g/l of phosphorous acid and sufficient stoichiometric amounts of nickel carbonate and methane sulfonic acid to form in situ Ni(methane sulfonate)$_2$ and result in a concentration of 70 g/l of $Ni^{+2}$.

The bath was employed to deposit a nickel-phosphorus coating on a steel plate using a conventional laboratory scale electroplating method with air agitation at 55° C. The anode was insoluble iridium oxide. The average current density was about 30 amp per dm$^2$. The pH of the bath at the start of plating was 1.7 and at the end of plating 1.4.

The deposition was carried out for 15 minutes to provide a coating 5 to 7 $\mu$m thick. The coating was adherent and semi-bright. The cathode efficiency was 55%.

EXAMPLE 5

An aqueous bath was prepared by adding to water, 10 g/l of phosphorous acid and sufficient stoichiometric amounts of nickel carbonate and methane sulfonic acid to form in situ Ni(methane sulfonate)$_2$ and result in a concentration of 70 g/l of $Ni^{+2}$.

The bath was employed to deposit a nickel-phosphorus coating on a steel plate using a conventional laboratory scale electroplating method with air agitation at 55° C. The anode was insoluble iridium oxide. The average current density was about 4 amp per dm$^2$. The deposition is carried out for 120 minutes. The pH of the bath at the start of plating was 1.6 and after 120 minutes was 1.0.

Nickel carbonate (5 g/l) was added to the bath. The nickel concentration increased from 67 g/l to 69.5 g/l and the pH increased to 1.4.

EXAMPLE 6

An aqueous bath was prepared by adding to water, 10 g/1 of phosphorous acid and sufficient stoichiometric amounts of nickel carbonate and methane sulfonic acid to form in situ Ni(methane sulfonate)$_2$ and result in a concentration of 50 g/l of $Ni^{+2}$.

The bath was employed to deposit a nickel-phosphorus coating on a steel plate using a conventional laboratory scale electroplating method with air agitation at 65° C. The anodes were nickel foil and insoluble iridium oxide. The average current density was about 4 amp per dm$^2$. The pH of the bath at the start of plating was 1.6 and at the end of plating was 1.4.

The deposition was carried out for 15 minutes to provide a coating 6 to 9 $\mu$m thick. The coating was adherent and semi-bright. The cathode efficiency was 71%.

EXAMPLE 7

A replenishing solution containing nickel phosphite was prepared by dissolving sufficient nickel methane sulfonate in water to obtain 65 g/l of $Ni^{+2}$ in solution. $NiCl_2$ (35 g/l) and boric acid (15 g/l) were added to the solution. An excess of phosphorus acid (65 g/l) was added to the solution which was then heated to 70° C. $CaCO_3$ (62 g/l) was added to the solution to precipitate the excess phosphite. The final concentration of phosphite after precipitation was 14 g/l.

EXAMPLE 8

A—A replenishing solution containing nickel phosphite was made by dissolving 5.68 g $NiCO_3$ in 50 ml water and then adding 8.8 g of solid phosphorus acid. The solution had a concentration of 55 g/l $Ni^{+2}$ (0.94 M) and 176 g/l $H_3PO_3$ (2.15 M), was clear and green, and had no signs of precipitates.

B—A nickel phosphorus plating solution of the invention containing 60 g/l $Ni^{+2}$ prepared from $NiCO_3$ and methane sulfonic acid and 15 g/l $H_3PO_3$ in a plating cell containing insoluble anodes of iridium oxide was used to plate a steel substrate. The plating was for 60 minutes at 10 A/dm$^2$ and at 70° C. The $Ni^{+2}$ concentration decreased from 60 g/l to 51.5 g/l and the phosphorus acid concentration decreased from 15 g/l to 13.8 g/l.

C—6.8 ml/l of the nickel-phosphite replenishment solution of A was used to bring the phosphorus acid back to 15 g/l and the $Ni^{+2}$ to 51.9 g/l.

EXAMPLE 9

Composite Coatings

A—Prepare a plating solution as in Example 1. Add 5 g/l aluminum oxide, $Al_2O_3$. After plating for 15 minutes, the substrate is removed. Aluminum oxide particles are dispersed within the NiP coating.

B—Prepare plating solution as in Example 1. Add 5 g/l of clay obtained from Southern Clay Products, Gonzales, Tex. After plating for 15 minutes, the substrate is removed. Visual examination showed clay particles were dispersed within the NiP coating.

C—Other composition coatings can be made using ceramic particles including: $SiO_2$, Al2, TiN, BC (born carbides), $MoS_2$, $MoSi_2$, diamond, metal-carbides.

EXAMPLE 10

Use of Ni Chelating Accents to Increase pH Range

Make nickel methanesulfonate solution containing 50 g/l $Ni^{+2}$. Add 1.0 moles of citric acid, 20 g/l ammonium chloride, 30 g/l boric acid. The solution is heated to 55° C. to dissolve all the components and then the pH is adjusted to 7.5–8.0 with ammonia. A steel panel is plated for 15 minutes. The nickel phosphorus coating is gray and smooth.

Throughout the specification, the inventors refer to various materials used in their invention as based on certain components, and intend that they contain substantially these components, or that these components comprise at least the base components in these materials.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

What is claimed is:

1. A composition of matter for producing electrodeposited nickel-phosphorus coatings, the composition being an aqueous sulfate free electroplating bath comprising a—from about 150 to 300 g/l nickel alkane sulfonate;

b—from about 5 to 40 g/l phosphorous acid;

c—from about 10 to 50 g/l phosphoric acid; and d—from about 5 to 25 g/l hypophosphorous acid;

wherein the coating is to be electrodeposited upon a substrate while maintaining a current density on the substrate of from 2 to about 200 A/dm2.

2. The composition of claim 1 further comprising, 0 to 60 g/l buffer, 0 to 2 ml/l surfactant, and 0 to 15 g/l stress reducing additive.

3. The composition of claim 2, further comprising 0 to 100 g/l nickel halogen.

4. The composition of claim 1 wherein the nickel alkane sulfonate is formed in situ in the bath.

5. The composition of claim 1 wherein the nickel alkane sulfonate is nickel methane sulfonate.

* * * * *